US005649465A

United States Patent [19]

Beebe

[11] Patent Number: 5,649,465

[45] Date of Patent: Jul. 22, 1997

[54] RESIZING DIE FOR USE IN A RELOADING PRESS

[75] Inventor: Richard W. Beebe, Cortland, N.Y.

[73] Assignee: Redding-Hunter, Inc., Cortland, N.Y.

[21] Appl. No.: 582,132

[22] Filed: Jan. 2, 1996

[51] Int. Cl.[6] ..... F42B 33/10

[52] U.S. Cl. ..... 86/37; 86/25; 86/24; 86/1.1; 29/1.3

[58] Field of Search ..... 86/37, 36, 23, 86/24, 25, 26, 31, 1.1; 29/1.3, 1.31

[56] References Cited

U.S. PATENT DOCUMENTS

| | | | |
|---|---|---|---|
| 3,175,456 | 3/1965 | Goodsell | 86/23 |
| 3,580,127 | 5/1971 | Lee | 86/24 |
| 3,744,292 | 7/1973 | Michelson | 86/24 |
| 3,745,875 | 7/1973 | Kennedy | 86/23 |
| 4,188,855 | 2/1980 | Alberts | 86/36 |
| 4,723,472 | 2/1988 | Lee | 86/24 |
| 5,221,806 | 6/1993 | Chaney et al. | 86/19 |

*Primary Examiner*—Michael J. Carone
*Assistant Examiner*—Christopher K. Montgomery
*Attorney, Agent, or Firm*—Harris Beach & Wilcox, LLP

[57] ABSTRACT

An apparatus for resizing the neck of a cartridge case which includes a housing secured to a stationary head of a reloading press. A support sleeve is attached within the housing such that the support sleeve can slide within a bore of the housing. The apparatus utilizes interchangeable bushings, located within the support sleeve, which each have substantially the same outside diameter but which have varying inside diameters. The bushings are marked with their inside diameter and the user selects a bushing with an inside diameter which the user determines will most accurately resize the neck. To change bushings, the top portion of the housing is separated from the bottom portion of the housing and the components inside the housing can then be slid out of the end of the bottom portion of the housing. A different bushing can be substituted for the one that was previously used. The neck of the cartridge casing is forced into the bushing such that the bushing causes the neck to decrease in diameter to resize the neck of the cartridge case. The apparatus may also include a decapping rod supported at both ends which ensures that the neck is round and uniform.

9 Claims, 2 Drawing Sheets

RESIZING DIE FOR USE IN A RELOADING PRESS

BACKGROUND OF THE INVENTION

1. Field of the Invention

This invention relates in general to an apparatus for resizing cartridge cases prior to reloading. More particularly, the invention relates to an improved apparatus for accurately resizing the necks of cartridge cases that vary in neck wall thickness due to their manufacturing tolerances.

2. Discussion of the Related Art

Many avid hunters and bench shooters prefer to reload their cartridges in an effort to attain greater accuracy. A reloading press is conventionally used for this purpose. Typically, the press contains a stationary head for supporting one or more dies used in the reloading process and a coacting moveable ram for moving cartridges in and out of the dies. After a cartridge is fired, the neck of the cartridge case expands from the pressure generated by the burning propellant. Therefore, one important function of the reloading process is to accurately resize the neck of a cartridge case so that the bullet will properly seat in the neck of the cartridge case. If the neck of a cartridge case is resized improperly, the bullet may not fit properly and/or may not remain concentric with the cartridge case body.

One problem with resizing dies of the past is that the resizing die does not support the cartridge case in axial alignment while the neck is being resized. Another problem is that due to manufacturing tolerances typically approaching 0.008 inch to 0.010 inch variation in the neck diameter of commercial ammunition, the die manufacturer is forced to manufacture neck resizing dies with a neck diameter that will work properly for the thinnest cartridges. This results in excessive resizing of the thicker cartridges, leading to distortion and decreased accuracy. A third problem with resizing dies of the past is that the decapping rod is supported at only one end. This leads to bending and misalignment of the decapping rod, which may cause misalignment of the neck of the cartridge case as the resizing button on the decapping rod passes through the neck.

Therefore, a resizing die is needed which overcomes such deficiencies of resizing dies of the past.

SUMMARY OF THE INVENTION

A resizing die is provided which overcomes the deficiencies of resizing dies of the past. The resizing die of the present invention is designed to be used in a reloading press having a stationary head and a moveable ram for supporting the cartridge case. The resizing die includes a housing with means for securing the housing in the stationary head of the press such as external threads on the housing adapted to mate with internal threads on the reloading press. The housing has a longitudinal bore through its entire length. The housing includes two parts, a micrometer sleeve and a body, which are removably attached to one another. A support sleeve is attached within the housing such that the support sleeve can slide within the bore of the housing. The support sleeve also has a bore longitudinally through its entire length. The support sleeve ensures that the cartridge case is held concentrically with the die throughout the resizing operation.

The apparatus utilizes interchangeable bushings, constructed preferably from hardened steel although other suitable materials are possible, located within the support sleeve, which each have substantially the same outside diameter but which have varying inside diameters. The bushings are marked with their inside diameter and the user selects a bushing with an inside diameter which the user determines will most accurately resize the neck, i.e. the bushing which will result in the most accurate fit between the neck and the bullet. If the resized neck is too large or too small, the bullet will not seat properly in the neck. The goal is to resize the neck as little as possible to avoid distortion of the neck, but enough to result in a press fit between the bullet and the neck. The process of selecting the proper bushing involves measuring the neck diameter and comparing that measurement to the bushing inside diameter. The selection process at first may require trial and error until the user becomes familiar with the relationship between the neck diameter and the most suitable bushing. To change bushings, the micrometer sleeve is separated from the body. The components inside the housing can then slide out of the end of the body of the housing and a different bushing can be substituted for the one that was previously used.

A bushing stop member is provided which has a longitudinal bore therethrough. The bushing stop is slidingly attached within the support sleeve and has a first end facing the micrometer sleeve and a second end facing the moveable ram. The second end of the bushing stop is adapted to contact the bushing. A stop shoulder is provided on a stop member which faces the first end of the bushing stop. As the cartridge case is pushed into the die, the support sleeve and bushing stop slide toward the micrometer sleeve. The upward movement of the bushing stop is stopped by the stop shoulder which prevents further movement of the bushing. The neck of the cartridge case is then forced into the bushing and the bushing causes the neck to decrease in diameter to resize the neck of the cartridge case.

The position of the stop shoulder is adjustable by means of a micrometer type rotating cap. The stop member is attached to the cap such that the stop member and cap turn in unison. The stop member has external threads which mate with internal threads on the micrometer sleeve. By turning the cap, the stop shoulder moves with respect to the micrometer sleeve. The micrometer sleeve has a vernier scale scribed vertically upon its outside surface and circumferentially around the upper portion of the cap. The scale indicates the position of the stop shoulder. By adjusting the position of the stop shoulder, the user can determine how much of the neck of the cartridge case is resized. When the stop shoulder is moved toward the ram, the movement of the bushing stop is arrested closer to the ram. Therefore, the neck of the cartridge case moves further into the bushing and more of the neck is resized. Under some circumstances, it may be desirable to resize only a portion of the neck. In this case, the stop shoulder is moved away from the ram. The bushing stop, and, hence, the bushing can then move further away from the ram. In this position, the neck of the cartridge case will only move partially into the bushing and only that portion of the neck will be resized.

Preferably, a decapping rod is provided which has a resizing button and a decapping pin. The decapping rod is threadably attached to the stop member. The stop member has internal threads adapted to mate with external threads on the decapping rod. As the cartridge case is moved into the die, the decapping pin is forced through the flash hole in the cartridge case to remove the spent primer that remains in the primer pocket of the cartridge case after firing. After the neck of the cartridge case has been resized by the bushing, the ram is moved away from the die. As this occurs, the resized neck is moved past the resizing button on the decapping rod. The resizing button has a diameter that is approximately one thousandth of an inch smaller than the diameter of the bullet. The resizing button ensures that the inside diameter of the necks of the cartridge cases with varying neck wall thickness are round and uniform and that the necks will be slightly smaller than the bullet so that when the bullet is placed into the neck, a press fit will hold the bullet in place.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF A PREFERRED EMBODIMENT

Figure 1:
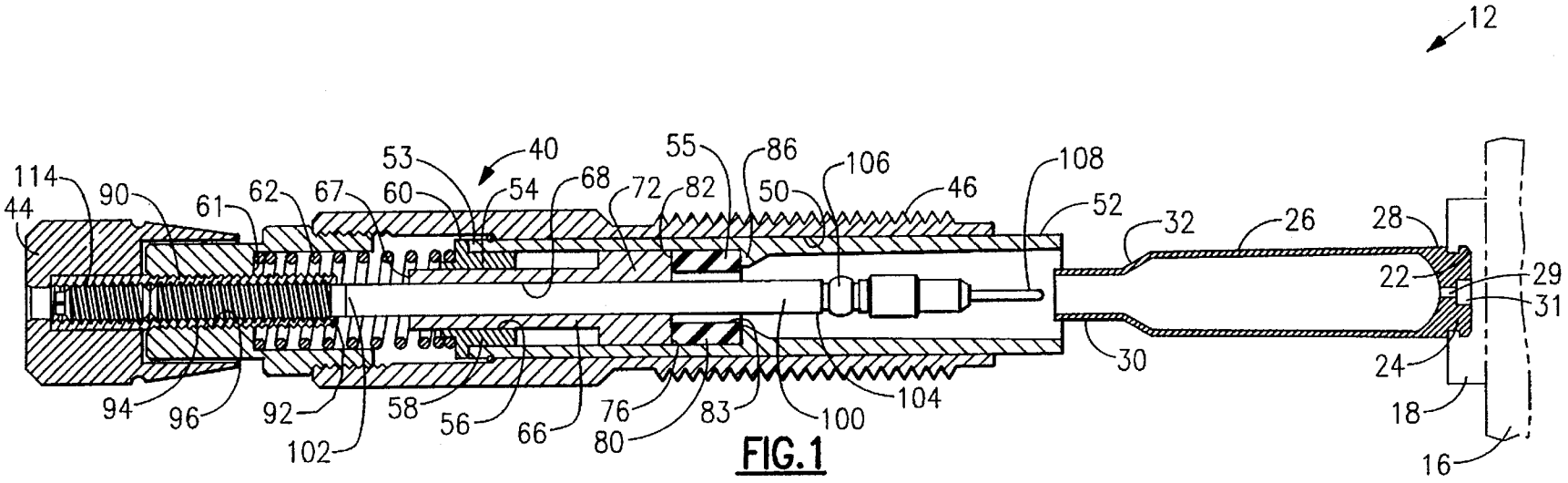
FIG. 1 is a cross sectional view of the resizing die of the present invention showing the support sleeve in a first position.

Referring now to the drawings, which are for the purpose of illustrating the preferred embodiment of the invention and not for the purpose of limiting the same, FIGS. 1–6 show the resizing die 10 of the present invention. The resizing die 10 is suitable for use in a reloading press generally referenced 12. The press is of conventional construction and includes a stationary head (not shown) and a coacting movable ram 16 which is shown in phantom outline in FIG. 1. A cartridge holder 18 is mounted on the top surface of the ram 16 and has a slotted opening 22 formed therein that is ganged to receive the rim 24 of the cartridge case 26 so as to support the cartridge case 26 in a vertical position beneath the die 10 as shown. When the cartridge case 26 is properly seated on the ram 16, the vertical center line of the cartridge case 26 and the axis of the die 10 are coextensive, and will remain so as the ram 16 moves upward toward the die 10. The cartridge case 26 contains a lower elongated body section 28 and a narrower open neck section 30 that are integrally joined by a tapered transition section 32. The neck 30, as manufactured, was pre-sized to a diameter whereby a bullet (not shown) could be forced into the neck 30 to form a tight friction fit between the two. After firing, the pressure of the burning propellant causes the neck to expand rendering it too large to hold a replacement bullet. In order for the cartridge case to be reloaded, the neck must be resized. One difficulty in resizing the neck of a cartridge case is caused by manufacturing tolerances of the brass which allow neck wall thickness to vary by eight to ten thousandths of an inch.

The die 10 includes a housing 40 that has an elongated hollow cylindrical body 42. The housing 40 also includes a cylindrical micrometer sleeve 41. The micrometer sleeve 41 has external threads 45 which mate with internal threads 47 on the body 42 such that the micrometer sleeve 41 can be separated from the body 42. The body 42 has external threads 46 that mate with the internal threads (not shown) formed in the stationary head of the reloading press 12 so that the die 10 can be secured in a vertical position over the movable ram 16. Other means of securing the die 10 are possible, as will be recognized by one skilled in the art.

The body 42 of the housing 40 includes an axially aligned internal bore 50, as best seen in FIG. 1. Within the bore 50 is a support sleeve 52 which is slidingly attached to the body 42. A collar 54 with a bore 56 therethrough is disposed within the bore 50. The collar 54 has a cylindrical portion 58 which fits within the support sleeve 52. A shoulder 60 is formed on the collar 54 which is adapted to abut the end 53 of the support sleeve 52. A shoulder 61 is formed in the micrometer sleeve 41. Preferably, a spring 62 is disposed between the shoulder 61 and the shoulder 60 of the collar 54 such that the support sleeve 52 is biased in the direction of the ram 16.

A bushing stop 66 with a bore 68 therethrough is slidably disposed within the support sleeve 52. The bushing stop 66 has a first cylindrical section 70 sized to be received by the bore 56 of the cylindrical portion 58 of the collar 54. The bushing stop 66 has a second cylindrical portion 72 sized to be received by the bore 55 of the support sleeve 52. A cylindrical bushing 80 is disposed within the bore 55 of the support sleeve 52. The bushing stop 66 has surface 76 which contacts surface 82 of the bushing 80. The bushing 80 also has surface 84 which is adapted to contact a shoulder 86 in support sleeve 52. Thus, the bushing 80 is held in place between the bushing stop 66 and the shoulder 86. It is contemplated that a plurality of different bushings 80', 80" (FIGS. 5 and 6), etc. will be used in the die 10. These bushings have the same outside diameter 81 but have varying inside diameters 83', 83". To change the bushing, the micrometer sleeve 41 is separated from the body 42 and the bushing stop 66 and bushing 80 are removed. A new bushing 80' and the bushing stop 66 are reinserted into the body 42. The micrometer sleeve 41 is then reattached to the body 42.

The interaction of the bushing stop 66 and a stop member 90 determines what portion of the neck 30 will be resized. The cap 44 is attached to the stop member 90 such that the stop member 90 and cap 44 turn in unison. The stop member 90 has external threads 94 that mate with internal threads 96 in the micrometer sleeve 41. Turning the cap 44 causes the stop member 90 to move axially relative to the micrometer sleeve 41. The stop member 90 has a stop shoulder 92. The bushing stop 66 has a surface 67 which is adapted to abut the stop shoulder 92 to prevent further movement of the bushing stop 66. By adjusting the position of the stop shoulder 92, the final position of the bushing stop 66, and, thus, the position of the bushing 80 is determined. The position of the bushing 80 determines what portion of the neck 30 of the cartridge case 26 is resized. The user may desire to resize only a portion of the neck 30 such as the upper half or the upper third of the neck 30 to minimize the potential for distortion of the neck 30.

Preferably, decapping rod 100 is disposed within the bore 83 in the bushing 80 and the bore 68 in the bushing stop 66. The decapping rod is threadably attached at a first end 102 to the stop member 90 and supported at a second end 104 by the bushing stop 66. The position of the decapping rod 100 can be adjusted by loosening the set screw 114. The position of the decapping rod 100, which is threaded into the stop member 90, can then be adjusted by turning the decapping rod 100. The decapping rod 100 has a resizing button 106 and a decapping pin 108, the purposes of which will be described below.

Figure 4:
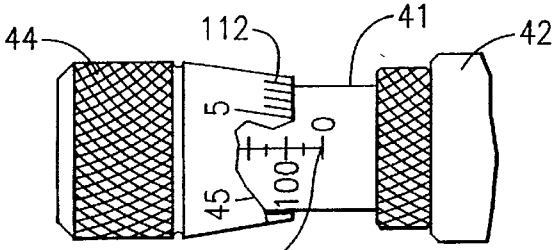
FIG. 4 is a partial cut away view of the cap and micrometer sleeve of the present invention.
Figure 6:
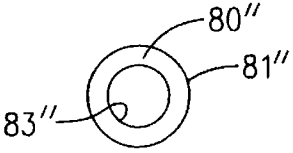
FIG. 6 is a top view of a second bushing of the present invention.
Figure 5:
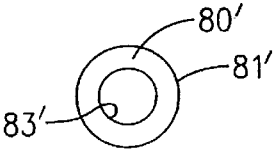
FIG. 5 is a top view of a bushing of the present invention.
Figure 2:
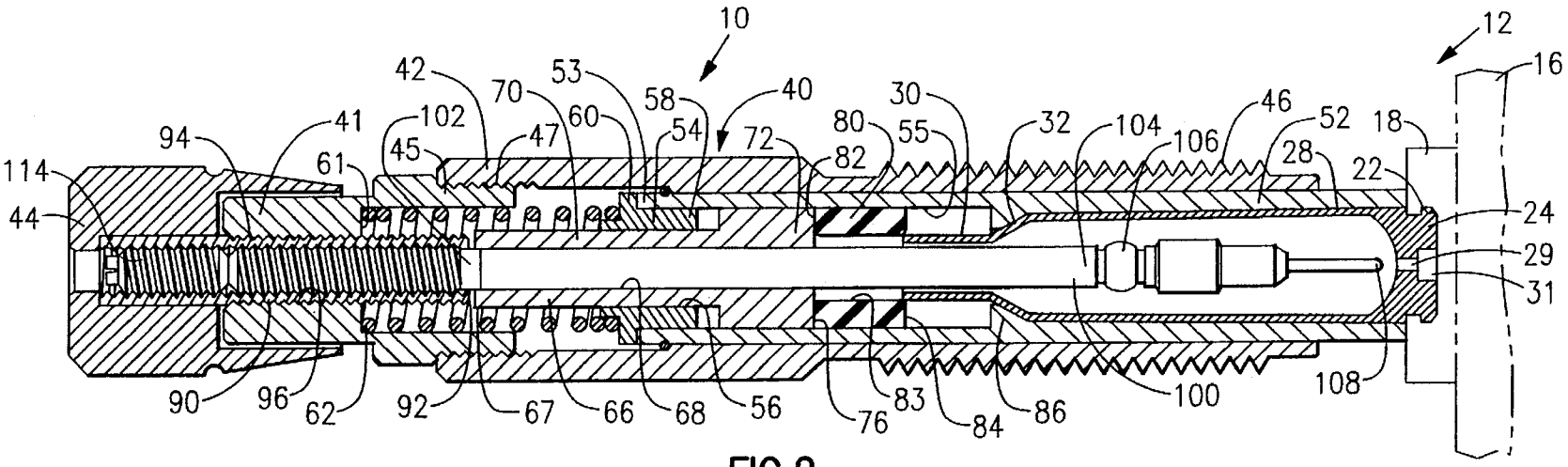
FIG. 2 is a cross sectional view of the resizing die of the present invention showing the support sleeve in a second position.
Figure 3:
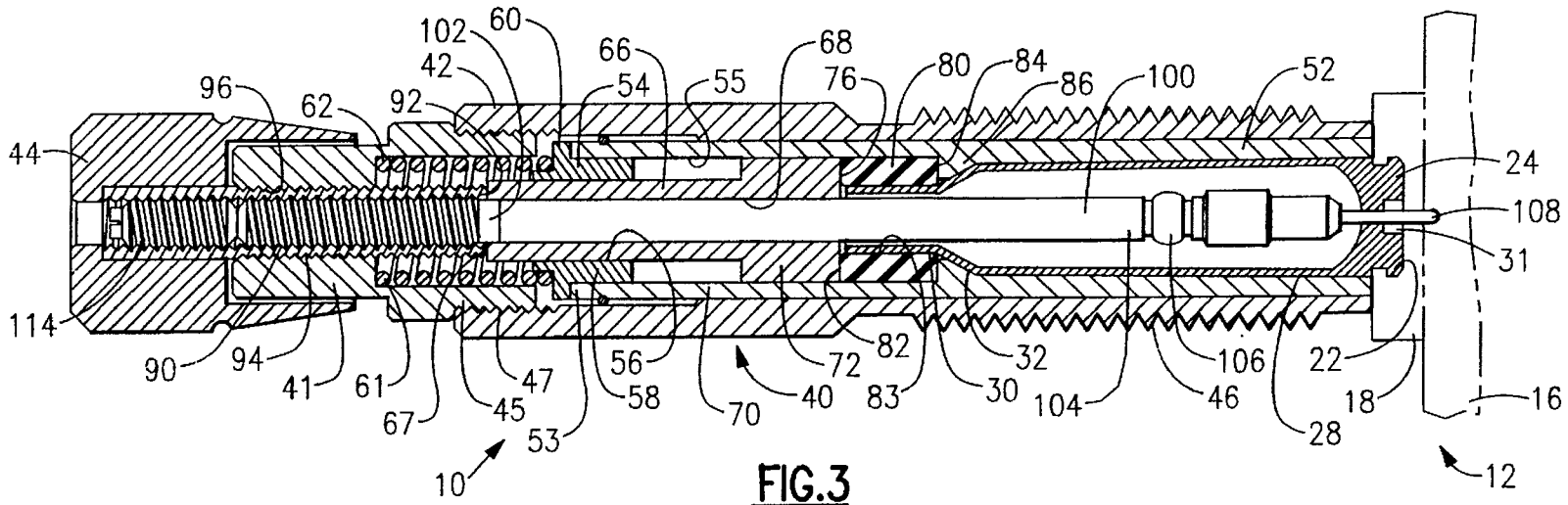
FIG. 3 is a cross sectional view of the resizing die of the present invention showing the support sleeve in a third position.

To operate the resizing die 10, the stop shoulder 92 is adjusted to the desired position by turning the cap 44. The location of the stop shoulder 92 can be determined by referring to the markings 112 on the cap 44 and the micrometer sleeve 41 (FIG. 4). Next, the cartridge case 26 is attached to the ram 16 and the ram 16 is moved upward forcing the cartridge case 26 into the support sleeve 52, as shown in FIG. 2. The cartridge case 26 is pushed further by the ram 16 which causes the support sleeve 52 to slide with respect to the housing 40 in the direction of the cap 44. The upward movement of the bushing stop 66 is stopped when the bushing stop 66 contacts the stop shoulder 92. As the cartridge case 26 continues to move toward the cap 44, the neck 30 is forced into the bushing 80 (FIG. 3). The bushing 80 reduces the diameter of the neck 30 and ensures that the bullet (not shown) will form a press fit with the neck 30. At the same time, the decapping pin 108 is forced through the flash hole 29 in the cartridge case 26 so that the spent primer remaining in the primer pocket 31 will be forced out of the cartridge case 26. Once the neck 30 of the cartridge case 26 has been moved past the bushing 80, the cartridge case 26 can then be removed from the die 10. The upward movement is reversed from the ram 16 and the spring 62 forces the support sleeve 52 out of the housing 40. As this occurs, the neck 30 of the cartridge case 26 is withdrawn over the resizing button 106 which ensures that the neck 30 is round and properly sized. The die 10 is then ready to accept another cartridge case.

Due to variations in manufacturing tolerances, cartridge cases will vary in the thickness of the brass. Therefore, the operator of the die 10 will select the next bushing with the inside diameter which will result in the most accurate fit between the neck 30 and the bullet (not shown). If the resized neck 30 is too large or too small, the bullet will not seat properly in the neck 30. The goal is to resize the neck 30 as little as possible to avoid distortion of the neck 30, but to ensure that the bullet and neck 30 form a press fit. To change bushings, the micrometer sleeve 41 is separated from the body 42 of the housing 40. The components inside the housing 40 can then slide out of the end of the body 42 of the housing 40 and a different bushing 80' can be substituted for the bushing 80 that was previously used.

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. A die for use in resizing a cartridge case for use in a reloading press having a stationary head and a moveable ram for supporting the cartridge case, the cartridge case having a base portion having a flash hole and an open neck portion, with the open neck of the cartridge case facing the stationary head of the press, comprising:

a housing having means for securing the housing in the stationary head of the press, said housing having a longitudinal bore therethrough;

a support sleeve slidingly attached within said housing, said support sleeve having a bore therethrough;

means for reducing the diameter of the neck of the cartridge case to a preselected inside diameter, said means adapted to be received by said bore in said support sleeve; and a bushing stop having a bore therethrough, said bushing stop slidingly attached to said bore in said support sleeve, said bushing stop having a first end facing the stationary head of the press and a second end facing the moveable ram, said second end of said bushing stop adapted to contact said means for reducing the diameter such that when said neck of the cartridge case is moved into said means for reducing the diameter the neck of the cartridge case is resized to a preselected inside diameter.

2. The apparatus of claim 1 wherein said means for reducing the diameter includes interchangeable bushings having different inside diameters.

3. The apparatus of claim 2 further including a decapping rod having a decapping pin at a first end, said decapping rod within said bore in said bushing stop, said decapping rod supported by said bushing stop adjacent said first end and by said housing at a second end such that as the cartridge case is moved into said housing, said decapping pin passes through said flash hole.

4. The apparatus of claim 3 wherein said decapping rod has a resizing button attached thereto such that when the cartridge case is removed from said bore of said bushing by the moveable ram, the neck of the cartridge case is withdrawn over said resizing button to ensure that as said neck is round and resized.

5. The apparatus of claim 1 further including means for biasing said sliding support sleeve toward said movable ram.

6. The apparatus of claim 5 wherein said biasing means includes a spring adapted to exert a force on said sliding support sleeve.

7. The apparatus of claim 1 further including a gauge means connected to said housing adapted to adjust the position of said bushing stop.

8. The apparatus of claim 1 further including means for indicating the position of said bushing stop within said housing.

9. A die for use in resizing a cartridge case for use in a reloading press having a stationary head and a moveable ram for supporting the cartridge case, which has a base portion and an open neck portion, with the open neck of the casing facing the stationary head of the press, comprising:

a housing having means for securing the housing in the stationary head of the press, said housing having a longitudinal bore therethrough;

a support sleeve slidingly attached within said housing, said support sleeve having a bore therethrough;

a bushing having a bore therethrough, said bushing adapted to be received by said bore in said support sleeve, said bushing having a preselected inside diameter;

a bushing stop having a bore therethrough, said bushing stop slidingly attached to said bore in said support sleeve, said bushing stop having a first end facing the stationary head of the press and a second end facing the moveable ram, said second end of said bushing stop adapted to contact said bushing;

a stop member adapted to contact said bushing stop to prevent movement of said bushing stop after a preselected distance;

means for replacing said bushing with a second preselected bushing; and a decapping rod disposed within said bores in said bushing and said bushing stop, said decapping rod supported by said bushing stop at one end and by said stop member at an opposite end, said decapping rod having a resizing button attached thereto such that when the neck of the cartridge case is forced into said bore of said bushing by the moveable ram, the neck of the cartridge case is reduced in diameter to a preselected size and when the cartridge case is removed from said bushing by the moveable ram, the neck of the cartridge case passes over said resizing button to ensure that said inside diameter of said neck is round and uniform.

* * * * *